US006870943B2

(12) United States Patent
Liu

(10) Patent No.: US 6,870,943 B2
(45) Date of Patent: Mar. 22, 2005

(54) CEILING LOUDSPEAKER

(76) Inventor: Hung-Ming Liu, 2F., No. 31-1, Lane 112, Su Wei Rd., Panchiao, Taipei Hsien (TW)

( * ) Notice: Subject to any disclaimer, the term of this patent is extended or adjusted under 35 U.S.C. 154(b) by 384 days.

(21) Appl. No.: 10/191,132

(22) Filed: Jul. 8, 2002

(65) Prior Publication Data

US 2004/0005073 A1 Jan. 8, 2004

(51) Int. Cl.[7] ..... H04R 25/00

(52) U.S. Cl. ..... 381/395; 381/386; 381/87; 181/150

(58) Field of Search ..... 381/301, 302, 381/386, 387, 388, 395, 86, 87; 181/150, 199

(56) References Cited

U.S. PATENT DOCUMENTS 3,912,865 A * 10/1975 Seebinger ..... 381/124
5,828,765 A * 10/1998 Gable ..... 381/386
6,683,963 B2 * 1/2004 Sterns et al. ..... 381/182

* cited by examiner

*Primary Examiner*—Suhan Ni

(74) *Attorney, Agent, or Firm*—Pro-Techtor International Services

(57) ABSTRACT

The present invention relates to a ceiling loudspeaker, primarily including adjustable fixing pieces at sides of speaker housing for installing the loudspeaker on the ceiling in position. Besides, a plurality of hooks are fitted to the speaker set, and tension springs are connected to the hooks while the speaker seat is hooked by the tension springs on the spring seats of the housing. Accordingly, the ceiling loudspeaker is convenient in assembly and stable in connection.

8 Claims, 6 Drawing Sheets

CEILING LOUDSPEAKER

BACKGROUND OF THE INVENTION

1. Field of the Invention

The present invention relates to a ceiling loudspeaker, and more particularly, to a loudspeaker on whose housing is provided with position-adjustable fixing pieces and spring seats hanging on a speaker seat while the speaker seat includes hooks and tension springs. Accordingly, the ceiling loudspeaker in accordance with the present invention is convenient in assembly and stable in connection.

2. Description of the Prior Art

A conventional ceiling loudspeaker, as shown in FIG. 1, includes a fixing seat 200 on the ceiling while a housing 100 thereof passes through a through hole prearranged on the ceiling 400 and is then screwed on the fixing seat 200 of the housing 100 by a screw 2001 passing through a through hole prearranged at top of the housing 100. The housing 100 is locked on the ceiling 400 by means of the arrangement of the fixing seat 200. Thereafter, a speaker seat 300 is mounted at the inner side of the housing 100. Accordingly, a conventional ceiling loudspeaker is completed.

However, the aforementioned structure of the conventional ceiling loudspeaker has its drawbacks. The fixing seat 200 is constructed by a narrow bent bar so that the ceiling loudspeaker is unstably placed. Besides, in assembly, the screw hole is uneasy to be aligned. Therefore, the fixing seat 200 is often moved or even fall down, thereby causing the inconvenience in assembly.

Furthermore, U.S. Pat. No. 5,143,339 discloses a speaker mounting assembly in which clips and springs are utilized to fix the peripheral rim of speaker onto a ceiling. In addition, the clips and the spring are also used to mount the speaker together with can on the panel. However, this fixing structure can't achieve a free adjustment in accordance with requirements of different thickness.

SUMMARY OF THE INVENTION

It is a primary object of the present invention to eliminate the aforementioned drawbacks and to provide a ceiling loudspeaker which includes upward and downward adjustable fixing pieces at sides of speaker housing which are fixed by butterfly screws on the speaker housing for installing the loudspeaker on the ceiling in position. Besides, a plurality of hooks are fitted to the speaker seat, and tension springs are connected to the hooks while the speaker seat is hooked by the tension springs on the spring seats of the housing. Accordingly, the ceiling loudspeaker is convenient in assembly and stale in connection.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
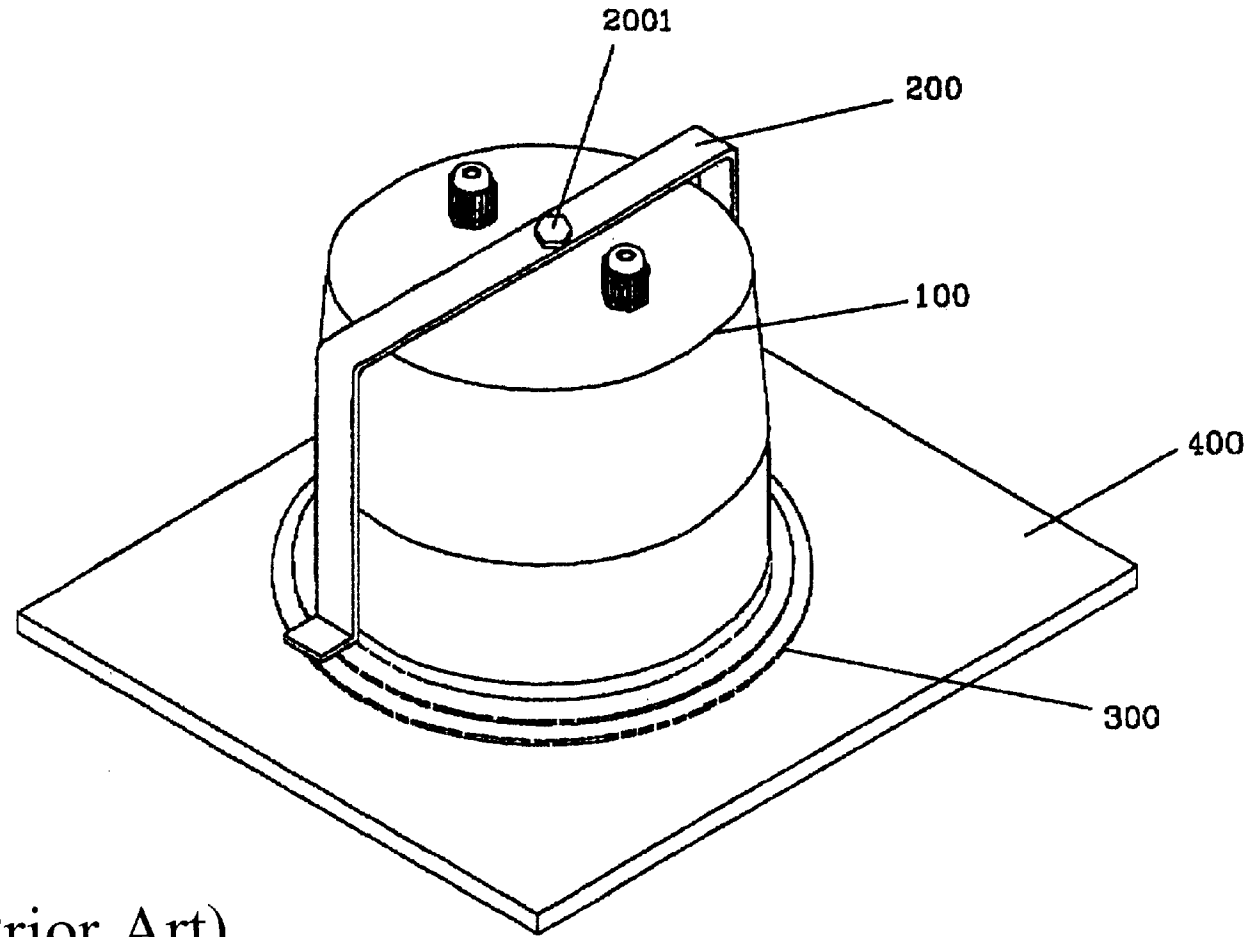
Fig.1 (Prior Art)
FIG. 1 is a perspective assembly view of a conventional ceiling loudspeaker.

FIG. 1 shows a perspective assembly view of a conventional ceiling loudspeaker. The configuration and the disadvantages thereof have been shown above and won't be described more hereinafter.

Figure 2:
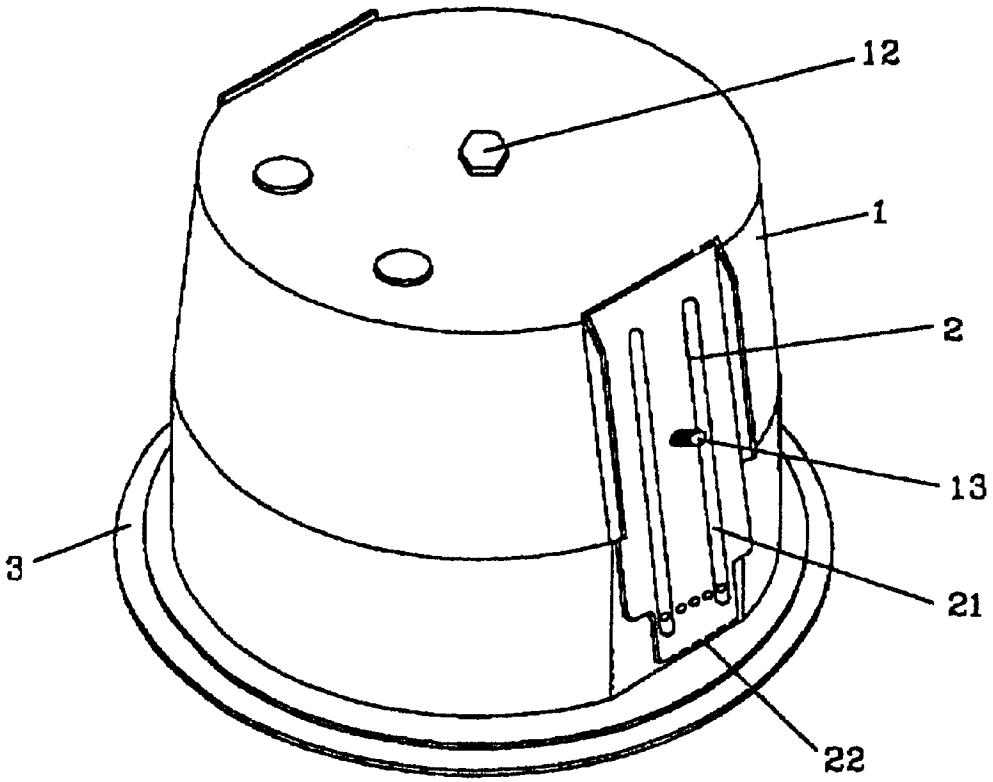
FIG. 2 is a perspective assembly view of a preferred embodiment of the present invention.
Figure 3:
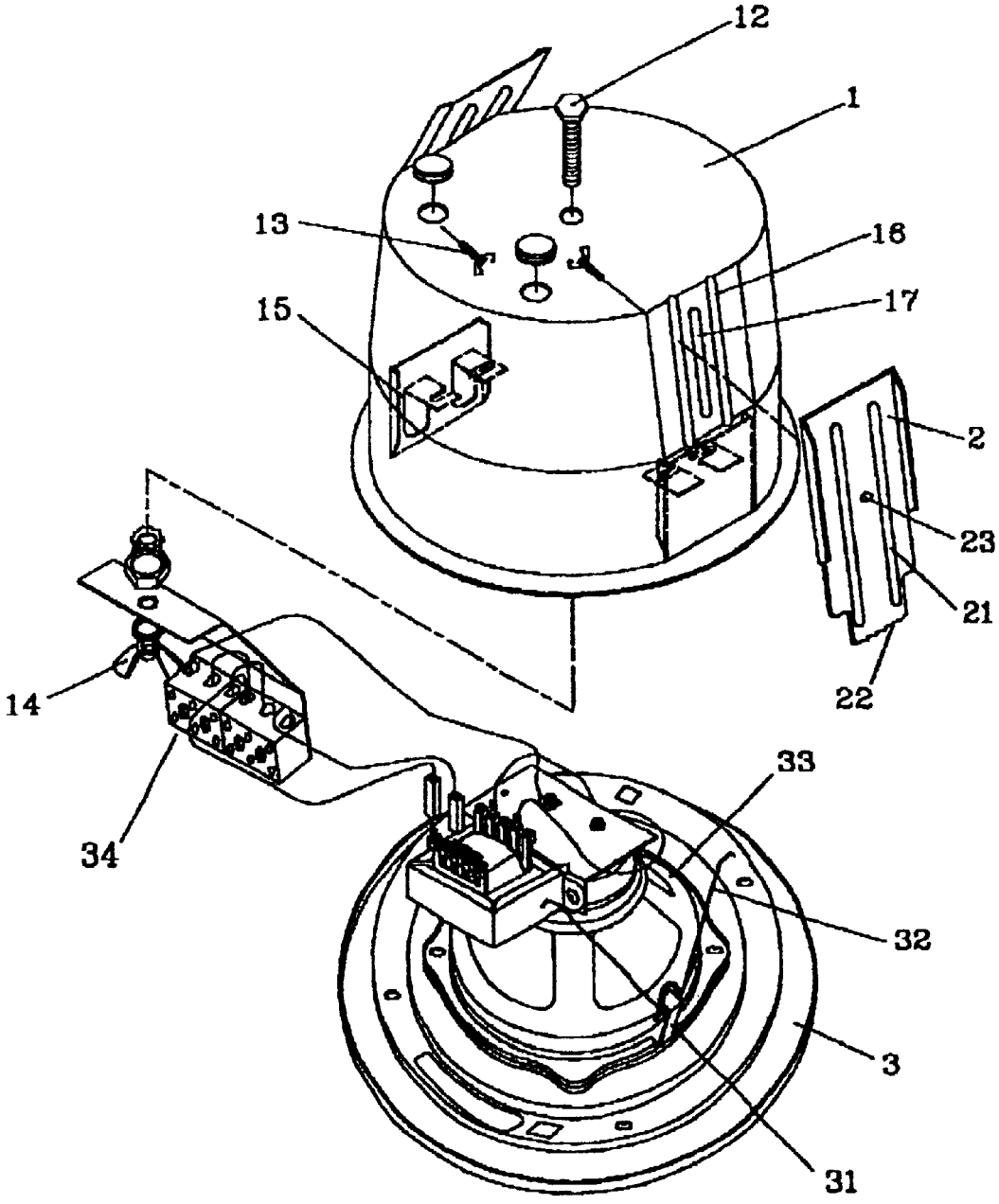
FIG. 3 is a perspective exploded view of the preferred embodiment of the present invention.

Referring to FIGS. 2 and 3, the ceiling loudspeaker in accordance with the present invention at least includes a housing 1, a plurality of fixing pieces 2 and a speaker seat 3. The housing 1 in shape of a hollow cylinder includes a screw 12 disposed at top thereof, a plurality of strip-type grooves 16 and slots 17 at outer sides thereof and a plurality of spring seats 15 at inner lower sides thereof. The fixing pieces 2 includes a plurality of grooves 21, thereby forming a plurality of ridges at corresponding position of the rear side thereof, zigzag projections 22 at bottom end thereof and a threaded hole 23 near the center thereof. The speaker seat 3 includes a plurality of projecting hooks 31 on each of which a V-shaped tension spring 32 is hooked while a speaker body 33 is mounted on the speaker seat 3 and connected to a wire connector 34 by means of electric cords.

In assembly, butterfly screws 13 passing through the slots 17 on the housing 1 and are fastened in the threaded holes 23 of the fixing pieces 2. Therefore, the ridges of the fixing pieces 2 are engaged in the grooves 16 of the housing 1. In loosening the butterfly screws 13, the grooves 16 serve as sliding rails and the fixing pieces 2 is slidable up and down on the grooves 16 of the housing 1. In tightening the butterfly screw 13, the fixing pieces 2 are fixed in place. Thereafter, the wire connector 34 is attached to the screw 12 on the housing 1 by means of a butterfly nut 14 while the tension springs 32 are hooked on the spring seats 15 of the housing 1, thereby joining the speaker seat 3 to the housing 1 to complete a whole structure.

Figure 4:
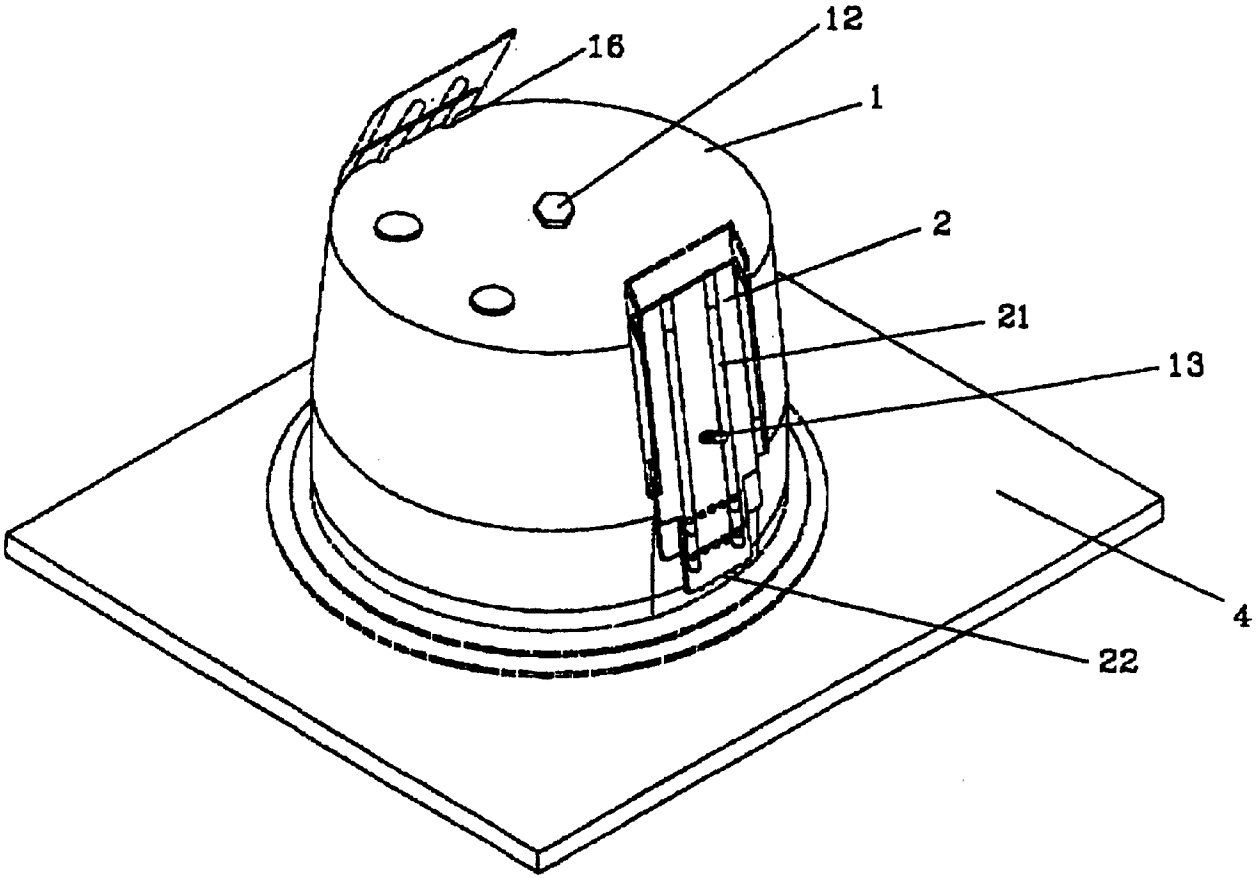
FIG. 4 is a first perspective view of the preferred embodiment of the present invention, showing the assembly way thereof.
Figure 6:
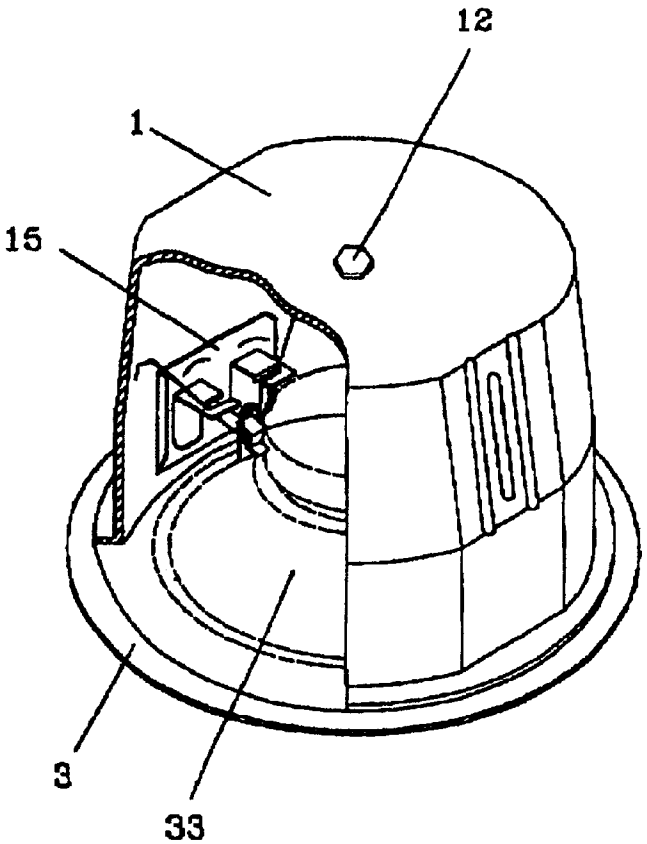
FIG. 6 is a third perspective view of the preferred embodiment of the present invention, showing the assembly way thereof.
Figure 5:
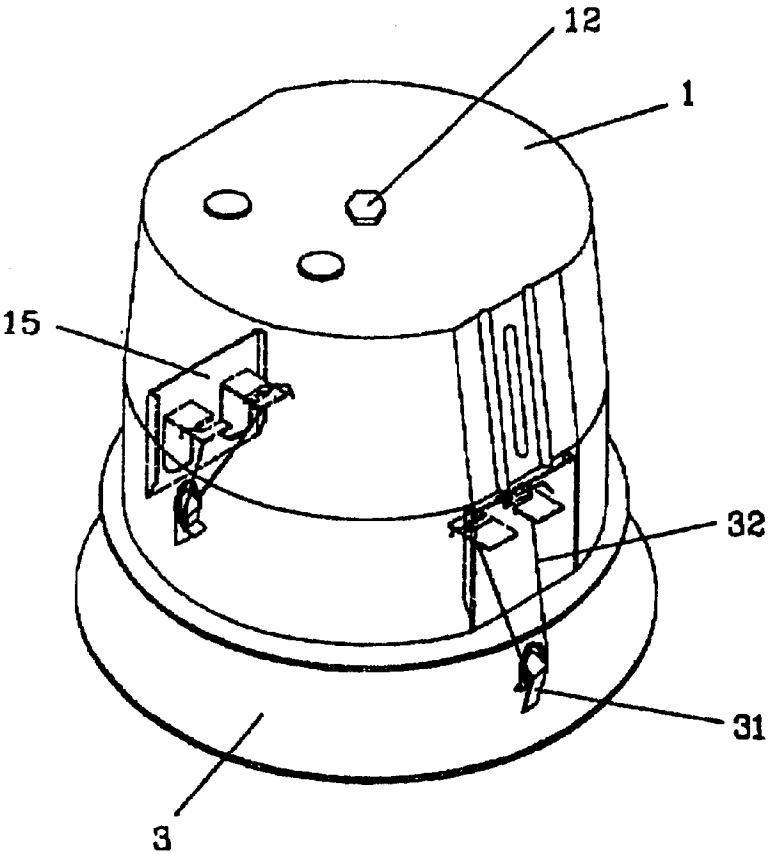
FIG. 5 is a second perspective view of the preferred embodiment of the present invention, showing the assembly way thereof.

Referring to FIGS. 4 through 6, they show the assembly way of the present invention. Firstly, separate the speaker seat 3 from housing 1, and place the housing 1 provided with fixing pieces 2 at two sides thereof into a through hole prearranged on the ceiling 4. Then, loosen the butterfly screws 13 for moving the fixing pieces 2 in order that the zigzag projections 22 of the fixing pieces 2 and the ceiling 4 are in close contact with each other (see FIG. 4), and fasten the butterfly screw 13. Thereafter, hook the tension springs 32 disposed at the projecting hooks 31 of the speaker seat 3 on the respective spring seats 15 while two projecting wires of the tension spring 32 are hooked in the grooves of the spring seats 15 (see FIG. 5). Furthermore, use the butterfly nut 14 to join the wire connector 34 to the screw 12 at top of the housing 1 while the speaker seat 3 is pushed upward against the inside of the housing 1. At last, the speaker seat 3 is locked under the ceiling 4 by means of the tension of the tension spring 32 (see FIG. 6). Accordingly, the assembly is completed.

Figure 7:
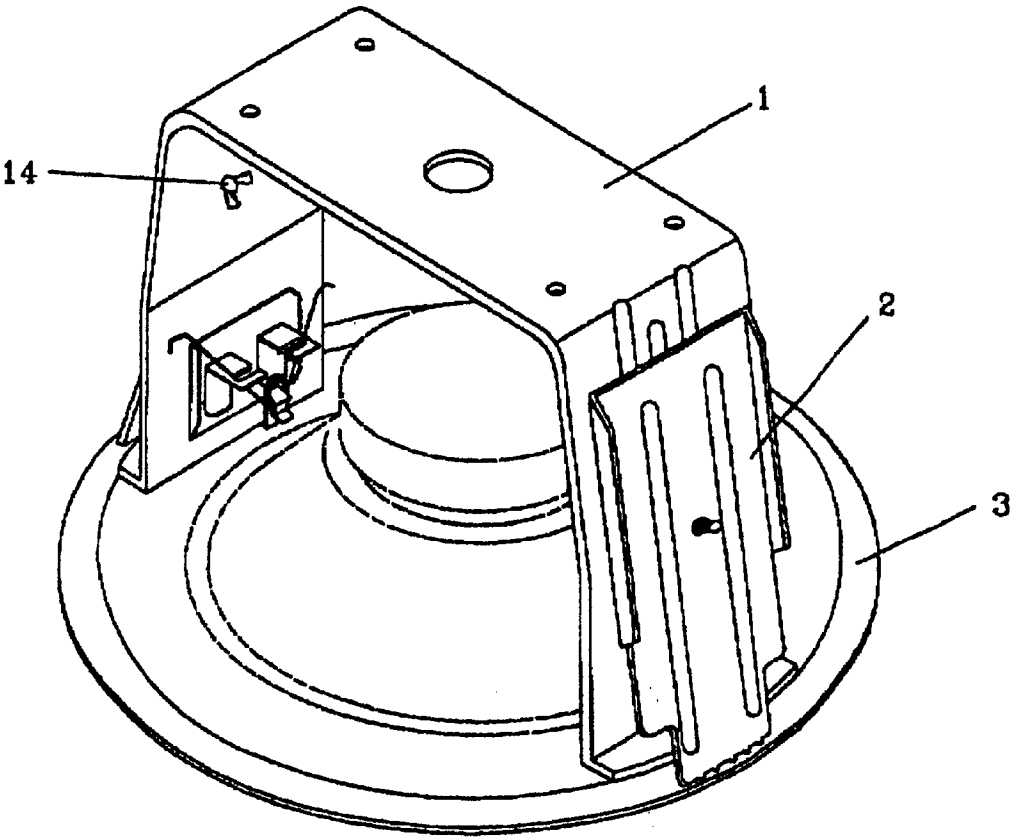
FIG. 7 is a perspective assembly view of another preferred embodiment of the present invention.

FIG. 7 shows a perspective assembly view of another preferred embodiment of the present invention. The housing 1 in accordance with the present invention is alternatively constructed in a U-shaped frame.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A ceiling loudspeaker at lest comprising:

a housing in shape of a hollow cylinder having a plurality of strip-type slots at outer sides thereof and a plurality of spring seats at inner lower sides thereof;

a plurality of fixing pieces having a threaded hole near the center thereof;

a speaker set having a plurality of projecting hooks on each of which a V-shaped tension spring is hooked while a speaker body is mounted on said speaker seat and connected to a wire connector by means of electric cords;

wherein, in assembly, butterfly screws passing through said slots of said housing are fastened in said threaded holes of said fixing pieces so that two fixing pieces are up and down slidably fixed on two sides of said speaker housing, whereupon said housing provided with fixing pieces at two sides thereof is pushed through a through hole prearranged on a ceiling while the position of said fixing pieces is adjusted in such a way that said fixing pieces and said ceiling are in close contact with each other; thereafter, join said tension springs disposed at said projecting hooks of said speaker seat to said respective spring seats of said speaker housing for hanging the speaker under said housing while said speaker seat is pushed upward against the inside of said housing; finally, said speaker seat is locked under said ceiling by means of the tension of the tension spring, and the assembly thereof is completed.

2. A ceiling loudspeaker as claimed in claim 1, wherein said housing is alternatively constructed in a U-shaped frame.

3. A ceiling loudspeaker as claimed in claim 1, wherein said housing includes a plurality of grooves, thereby forming a plurality of ridges at corresponding position of the rear side thereof, and wherein, in assembly, said ridges are engaged into said respective grooves of said housing so that said grooves serve as sliding rails and said fixing pieces is slidable up and down thereon.

4. A ceiling loudspeaker as claimed in claim 2, wherein said housing includes a plurality of grooves, thereby forming a plurality of ridges at corresponding position of the rear side thereof, and wherein, in assembly, said ridges are engaged into said respective grooves of said housing so that said grooves serve as sliding rails and said fixing pieces is slidable up and down thereon.

5. A memory card connection arrangement as claimed in claim 1, wherein zigzag projections are formed at bottom end of said fixing pieces.

6. A memory card connection arrangement as claimed in claim 2, wherein zigzag projections are formed at bottom end of said fixing pieces.

7. A memory card connection arrangement as claimed in claim 1, wherein a screw is disposed at top of said housing in order that said wire connector is fastened by a butterfly nut with said screw.

8. A memory card connection arrangement as claimed in claim 2, wherein a screw is disposed at top of said housing in order that said wire connector is fastened by a butterfly nut with said screw.

* * * * *